US005987844A

United States Patent [19]

Reid et al.

[11] Patent Number: 5,987,844

[45] Date of Patent: Nov. 23, 1999

[54] SNAP-LOCK VISION FRAME ASSEMBLY

[75] Inventors: Marvin Reid, Placentia; David Chipman, Huntington Beach, both of Calif.

[73] Assignee: Anemostat Products Division, Dynamics Corp. of Amerca, A New York Corp., Carson, Calif.

[21] Appl. No.: 09/153,096

[22] Filed: Sep. 14, 1998

[51] Int. Cl.[6] ..... E04C 2/38

[52] U.S. Cl. ..... 52/656.5; 52/656.2; 52/656.6; 52/208; 52/455

[58] Field of Search ..... 52/656.2, 656.5, 52/656.6, 208, 455

[56] References Cited

U.S. PATENT DOCUMENTS 3,768,220 10/1973 Riegelman, Jr. ..... 52/204

3,969,857 7/1976 Stark ..... 52/208

4,550,542 11/1985 La See ..... 52/476

*Primary Examiner*—Christopher T. Kent

*Assistant Examiner*—Nkeisha J. Maddox

*Attorney, Agent, or Firm*—Bruce A. Jagger

[57] ABSTRACT

A vision frame assembly for use in fire-rated structures such as doors and walls. The frame assembly includes a pair of opposed frame members that snap-fit into a plurality of resilient latching clips mounted in the door or wall. The latching clips include mounting members to mount the clip to the door or wall and spring finger elements having differing lengths. The unique configuration of the spring finger elements makes the frame assembly adaptable to wide tolerance variations from different manufactures of doors, walls, and other fire-rated structures.

14 Claims, 6 Drawing Sheets

SNAP-LOCK VISION FRAME ASSEMBLY

BACKGROUND OF THE INVENTION

1. Field of the Invention

This invention relates to mounting frames for holding glazings such as windows in structures, and more particularly to the snap lock vision frame assemblies in fire-rated structures such as doors and walls.

2. Description of the Related Art

The installation of vision frame assemblies in doors, especially of the fire-rated variety, has often been a difficult and time-consuming process. Prior art frame assemblies are often constructed of several parts that must be separately manufactured and inventoried. FIG. 1 illustrates a portion of such an assembly 10 installed in a cutout 12 of a wooden fire-rated door 14. The frame assembly 10 includes a front frame member 16 connected to a rear frame member 18 by a series of screws 20 arranged around the perimeter of the frame assembly 10. Each frame member 16, 18 includes an outer flange 22 connected to an inner flange 24 by a captive edge 26. The outer flange 22 has a first vertically oriented panel 28 that abuts a vertical surface 30 of the door 14 adjacent the cutout 12 and a second panel 32 that extends obliquely from the first panel 28 to the captive edge 26. The outer flange 22 of the rear frame member also includes apertures 31 for receiving the screws 20. The inner flange 24 of each frame member has a first vertically oriented panel 34 that extends from the captive edge 26 to a step portion 36. The step portion 36 extends generally horizontally to a vertically-oriented mounting lip 38. Each mounting lip 38 has an aperture for receiving the screw 20. When assembled, the panels 34 face each other to create a pocket 40 that receives a peripheral edge portion of a window pane or glazing 42 and glazing tape 44 located on opposite sizes of the glazing 42.

During installation, the front frame member 16 must be manually held in place while a layer of glazing tape 44, the glazing 42, another layer of glazing tape 44, and the rear frame member 18 are installed. Accordingly, installation can be quite awkward and can require much time and skill. Moreover, the finished product is neither entirely aesthetically pleasing nor secure, since the screw heads are exposed on the rear frame member. In addition, the front and rear frame members are not identical and therefore require a separate manufacturing operations. Separate inventories must be kept for each of the frame members, screws, and different thicknesses of tapes due to tolerance variations in the door and glazing thicknesses.

For hollow fire-rated doors 46 as shown in FIG. 2, the same frame assembly 10 can be used with the addition of reinforcing clips 48 installed at various locations around a cutout 50 in the door 46 to strengthen the door cutout. As seen in FIG. 3, the reinforcing clip 48 has a plate portion 52 with mounting lips 54, 56 extending from opposite ends of the plate portion, and an intermediate lip 57 extending between the opposite ends and generally transverse to the mounting lips 54, 56. When installed, the reinforcing clips 48 hold a front metallic skin 58 and a rear metallic skin 60 against a hollow core material 62. In addition to the disadvantages described with respect to wooden doors, the reinforcing clips require additional manufacturing, inventory, and increased installation time.

Another prior art clip 64 for mounting in hollow door cutouts is illustrated in FIG. 4. The clip 64 has a plate portion 66 with mounting lips 68, 70 extending from opposite ends of the plate portion. A first tab 72 is mounted adjacent the lip 70 and a second tab 74 is mounted adjacent the lip 68. The tabs 72, 74 extend generally transverse to the lips 68 and are formed at diagonally opposite corners of the plate portion 66. A first spring finger 76 has a first end adjacent the lip 70 and a second free end that projects toward the lip 68. Likewise, a second spring finger 78 has a first end adjacent the lip 68 and a second free end that projects toward the lip 70. Each spring finger 76, 78 has a stepped portion 80 that together form a channel for receiving the peripheral edge portion of a window pane and frame members. Although this prior art clip possesses some advantages over other prior art arrangements, it is not, inter alia, adaptable to tolerance variations in the door, window pane, and glazing tape thicknesses, as well as variations in glazing space between the frames. Moreover, the clip 64 is not universal for both solid and hollow doors.

SUMMARY OF THE INVENTION

It is an object of the present invention to provide a vision frame assembly, which, among other things, is low in cost, has relatively few parts, is relatively easy and quick to install, is universal for both solid and hollow fire-doors and other structures, is adaptable to wide tolerance variations from different manufactures of doors, glazings, and glazing tapes, as well as variations in glazing space between the frames, and is aesthetically pleasing.

According to the invention, a snap-lock vision frame assembly with a generally closed perimeter comprises a pair of frame members and a resilient latching clip component or mounting bracket. The resilient latching clip component includes a pair of mounting members disposed on opposed edges of a plate portion. The plate portion has a mid-region generally intermediate the opposed edges. At least two generally spaced apart opposed sets of elongated spring finger elements depend respectively from generally adjacent the opposed edges and project angularly towards the mid-region. Preferably, each of the elongated spring finger elements is generally resiliently mounted to the plate portion by one end and terminates in a free end remote from the one end. Each set of elongated spring finger elements includes at least two elongated spring finger elements of differing lengths. The free ends of the elongated spring finger elements in the respective opposed sets of elongated spring finger elements are spaced apart in the mid-region to define therebetween a flange receiving channel such that the free ends define respective sides of the flange receiving channel.

Each of the first and second frame members has an outer flange and an inner flange. The outer flange extends between an outer free edge and a captive edge such that the captive edge is shared with the inner flange. The inner flange extends between the captive edge and an inner free edge and includes a step intermediate the captive and inner free edges. The step extends generally away from the outer free edge and the inner and outer free edges are spaced apart by a fixed distance. Preferably, the fixed distance is approximately equal to the distance between an opposed edge and the closest side of the flange receiving channel of the mounting bracket. The flange receiving channel is wide enough to receive a margin of each of the inner flanges adjacent the inner free edges. At least one of the free ends from each of the sets of elongated spring fingers are adapted to bear against the margin of an adjacent inner flange.

Preferably, the resilient latching clip component is unitary and each of the first and second frame members are unitary. The mounting members include a leg spaced apart from a barb to define therebetween a door skin receiving channel.

The leg and barb depend from the door skin receiving channel distal from the flange receiving channel. The generally spaced apart opposed sets of elongate spring finger elements comprise at least two, and preferably four sets of elongated spring finger elements. The opposed sets of spring finger elements are generally symmetrical around the flange receiving channel and an axis that is generally perpendicular to the direction of the flange receiving channel.

According to a further embodiment of the invention, a snap lock vision frame assembly includes a door having a cutout therein with a closed periphery. The assembly comprises a plurality of resilient latching clip components arrayed around the cutout and first and second frame members mounted in the cutout in engagement with the latching clips. Each of the resilient latching clip components includes a pair of mounting members that are disposed on opposed edges of a plate portion and are engaged with an edge of the cutout. The plate portion has a mid-region generally intermediate the opposed edges. At least two generally spaced apart opposed sets of elongated spring finger elements depend respectively from generally adjacent the opposed edges and project angularly towards the mid-region. Each of the elongated spring finger elements is generally resiliently mounted to the plate portion by one end and terminated in a free end remote from the one end. Each of the sets of elongated spring finger elements includes at least two elongated spring finger elements of differing lengths to accommodate the need for flange receiving channels of different widths. The free ends of the elongated spring finger elements in the respective opposed sets of elongated spring finger elements is preferably spaced apart in the mid-region to define therebetween a flange receiving channel, with the free ends defining respective sides of the flange receiving channel.

The first and second frame members are engaged with the resilient latching clip components in the cutout. Each of the frame members has an outer flange and an inner flange, with the outer flange extending between an outer free edge and a captive edge and the captive edge being shared with the inner flange. The inner flange extends between the captive edge and an inner free edge and includes a step intermediate the captive and inner free edges. The step extends generally away from the outer free edge. The steps in the first and second frame members define between them the width of a glazing receiving pocket with the inner and outer free edges generally being spaced apart by a fixed distance. The fixed distance is approximately equal to the distance between an opposed edge and the closest side of the flange receiving channel. A margin of each inner flange adjacent the inner free edges is generally received in the flange receiving channel of each resilient latching clip component. At least one of the free ends from each set of elongated spring fingers generally bears against the margin of an adjacent inner flange to hold the first and second frame members in the cutout.

According to an event further embodiment of the invention, a snap lock vision frame assembly has a generally closed perimeter and comprises first and second frame members and a resilient latching clip component for mounting the frame members to the cutout of a door.

The first frame member has a first external face and a first glazing face, with the first external face extending generally between a first outer edge of the first external face and a first edge of the first glazing face. The first glazing face includes a first panel extending between the first edge and a first step, with the first step extending away from the first outer edge. A first flange depends from the first step and the first flange terminates in a first spring finger engaging margin.

The second frame member has a second external face and a second glazing face, with the second external face extending generally between a second outer edge of the second external face and a second edge of the second glazing face. The second glazing face includes a second panel extending between the second edge and a second step, with the second step extending away from the second outer edge. A second flange depends from the second step and the second flange terminates in a second spring finger engaging margin. The first and second frame members are adapted to be mounted with the first and second flanges in opposing relationship and with the first and second panels spaced apart and defining therebetween a glaze receiving nest.

The resilient latching clip component includes a pair of mounting members disposed generally on opposed edges of a plate portion. The plate portion has a mid-region intermediate the opposed edges. The spring finger elements in a first set of elongated spring finger elements are resiliently cantilevered from the plate portion generally adjacent a first of the opposed edges and extend towards the mid-region at an acute angle. The spring finger elements in a second set of elongated spring finger elements are resiliently cantilevered from the plate portion adjacent a second of the opposed edges and extend towards the mid-region at an acute angle. Each of the sets of elongated spring finger elements preferably includes at least two elongated spring finger elements of differing lengths so as to provide a series of channels of different widths. Each of the elongated spring finger elements has a free end that is adjacent the mid-region and spaced from the plate portion by a predetermined distance. The free ends of the elongated spring finger elements in the respective first and second sets of elongated spring finger elements define therebetween a series of coincident channels that are of slightly different widths. The first and second spring finger engaging edges are adapted for reception in the channel with at least one of the elongated spring finger elements in each of the sets of elongated spring finger elements bearing on an adjacent face of one of the first and second flanges.

Other objects, advantages, and novel features of the present invention will become apparent from the following detailed description of the invention when considered in conjunction with the accompanying drawings.

BRIEF DESCRIPTION OF THE INVENTION

The present invention provides its benefits across a broad spectrum commerce. While the description which follows hereafter is meant to be representative of a number of such applications, it is not exhaustive. As those skilled in the art will recognize, the basic apparatus taught herein can be readily adapted to many uses. It is the applicant's intention that this specification and the claims appended hereto be accorded a breadth in keeping with the scope and spirit of the invention being disclosed despite what might appear to be limiting language imposed by the requirements of referring to the specific examples disclosed.

Referring to the drawings for the purposes of illustration only and not limitation:

DETAILED DESCRIPTION OF THE PREFERRED EMBODIMENTS

Figure 1:
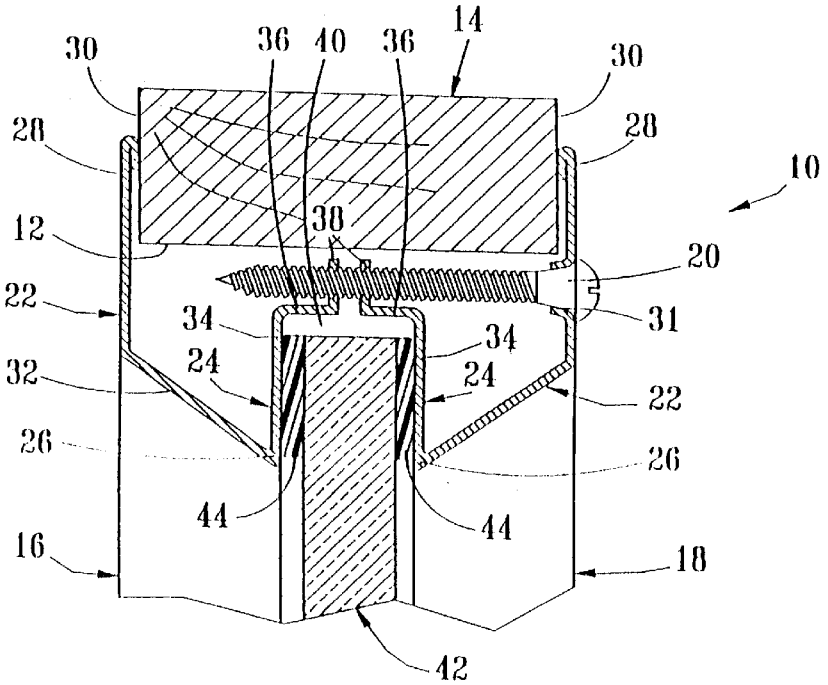
FIG. 1 (Prior Art)
FIG. 1 is a cross sectional view of a portion of a prior art vision frame assembly.
Figure 3:
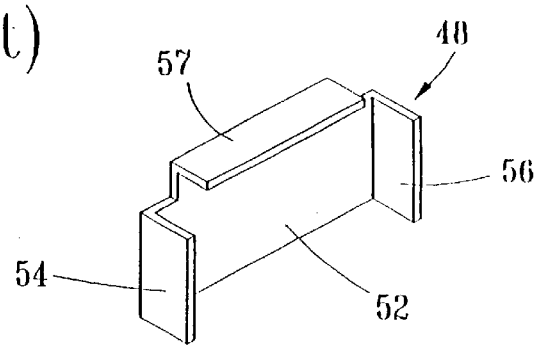
FIG. 3 (Prior Art)
FIG. 3 is an orthographic view of the prior art clip arrangement of FIG. 2.
Figure 2:
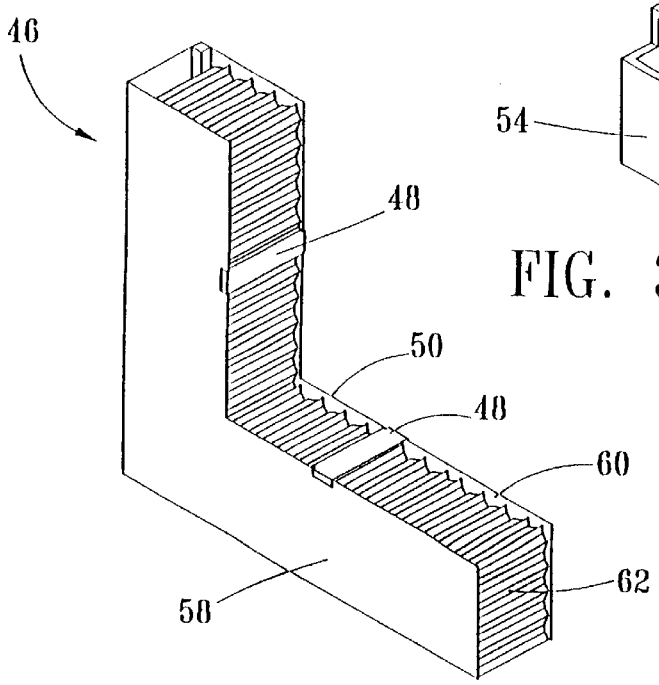
FIG. 2 (Prior Art)
FIG. 2 is an orthographic view of a prior art clip arrangement installed in a cutout of a hollow fire-rated door.
Figure 4:
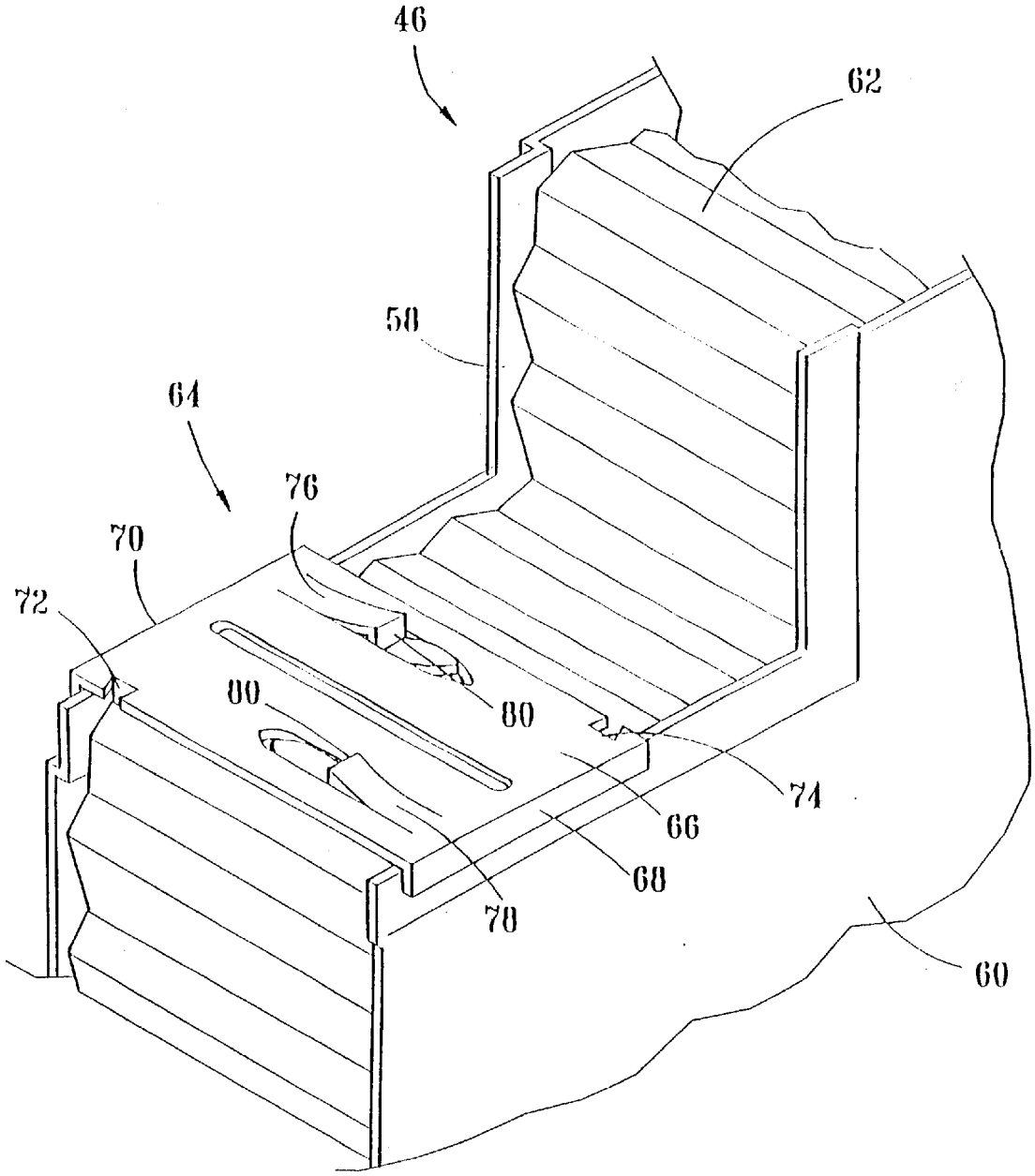
FIG. 4 (Prior Art)
FIG. 4 is an orthographic view of a prior art clip installed in a cutout of a hollow fire-rated door.
Figure 5:
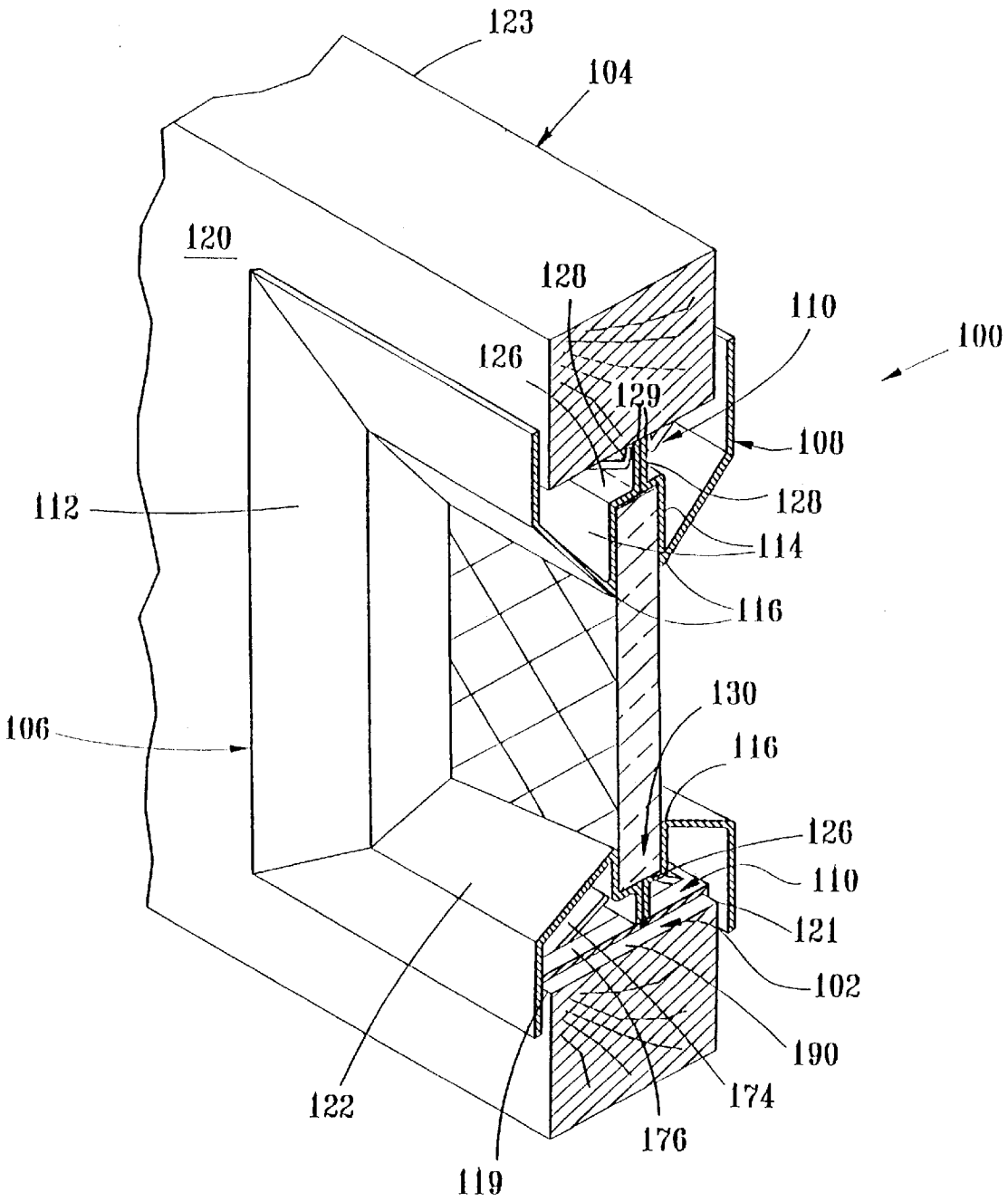
FIG. 5 is an orthographic cross sectional view of a portion of a self-locking vision frame assembly according to the invention installed in a wooden door.
Figure 6:
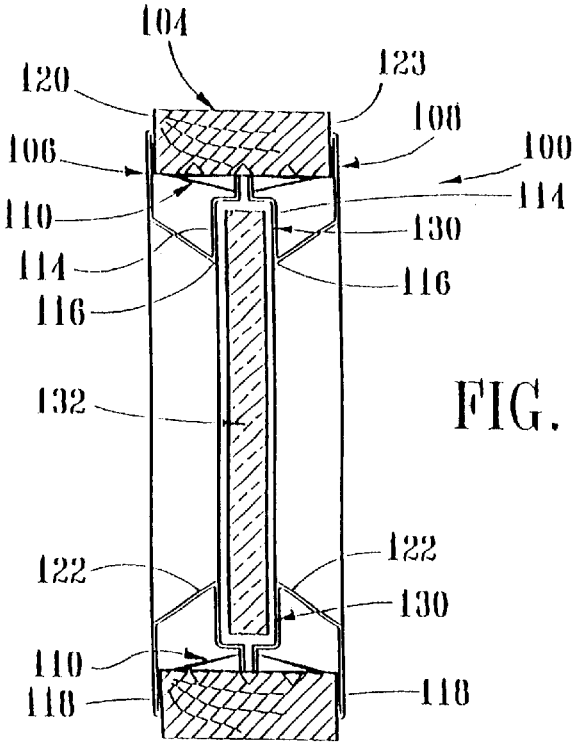
FIG. 6 is an elevated cross sectional view of the vision frame assembly according to the invention.
Figure 7:
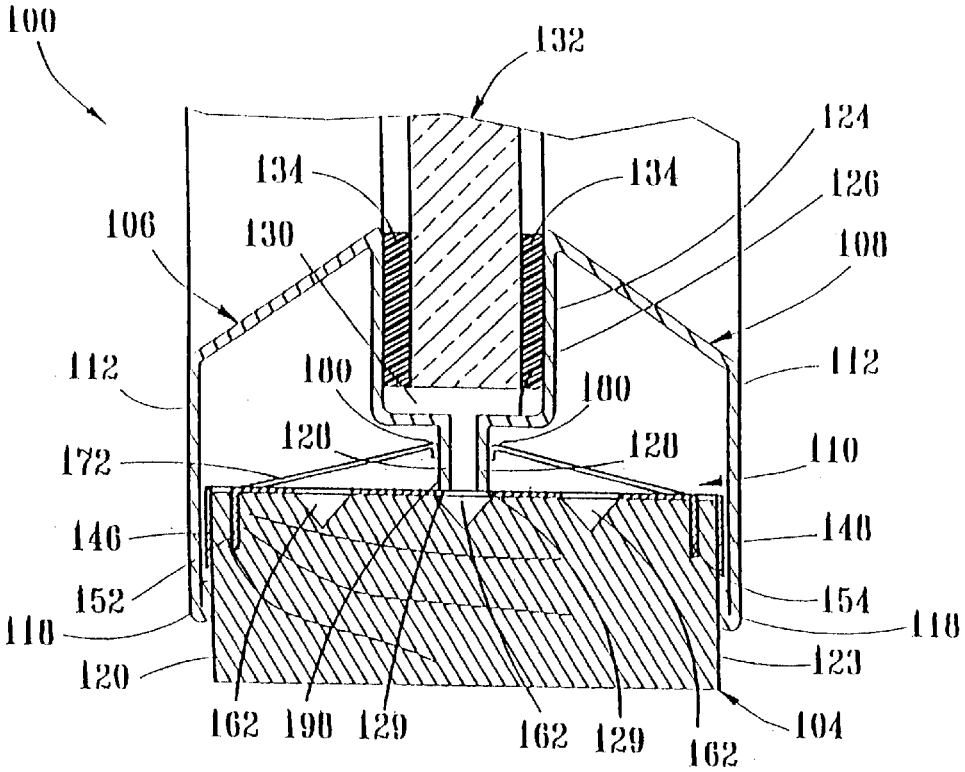
FIG. 7 is an enlarged cross sectional view of a portion of the vision frame assembly of FIG. 6 and showing glazing tape installed.

Referring now to the drawings, and to FIGS. 5–7 in particular, a snap-lock vision frame assembly 100 according to the invention is shown installed in a cutout 102 of a wooden or solid fire-rated door 104. The frame assembly 100 includes a front frame member 106 connected to a rear frame member 108 by mounting brackets 110 arranged at spaced locations around the perimeter of the cutout 102. The frame members 106, 108 are identical in configuration and each includes an outer flange 112 connected to an inner flange 114 by a captive edge 116. The outer flange 112 has a first generally normally vertically oriented panel 118 that is adapted to abut a forward normally vertical surface 120 or a rearward normally vertical surface 123 of the door 104 adjacent a forward cutout edge 119 or a rearward cutout edge 121, and a second panel 122 that extends obliquely from the first panel 118 to the captive edge 116. As will be understood by those skilled in the art, the outer frame can be multifaceted, as shown, or arcuate, as desired. The inner flange 114 of each frame member 106, 108 has a first generally normally vertically oriented panel 124 that extends from the captive edge 116 to a step portion 126. The step portion 126 extends generally normally horizontally to a generally normally vertically oriented mounting lip or margin 128 at an inner free edge 129 of the inner flange 114. When assembled, the panels 124 of each frame member 106 face each other and the step portions 126 are generally in normally horizontal alignment to create a pocket or nest 130 that receives a peripheral edge portion of a window pane or glazing 132 and glazing tape 134 (FIG. 7) or other sealing means located on opposite sizes of the glazing 132. While doors and windows are normally mounted vertically, other orientations are possible. As used herein, "vertically" and "horizontally" are used to indicate relative, not absolute, orientation.

Figure 8:
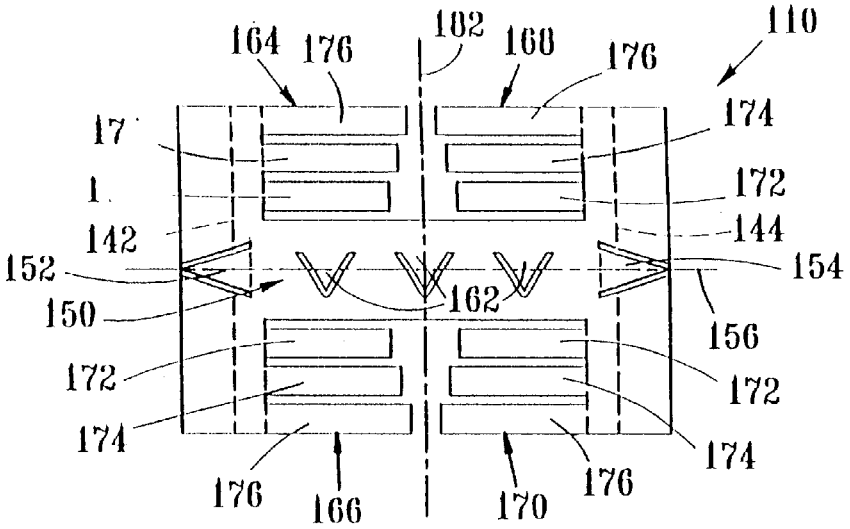
FIG. 8 is a top plan view of a stamped retention clip blank according to the invention prior to bending.
Figure 9:
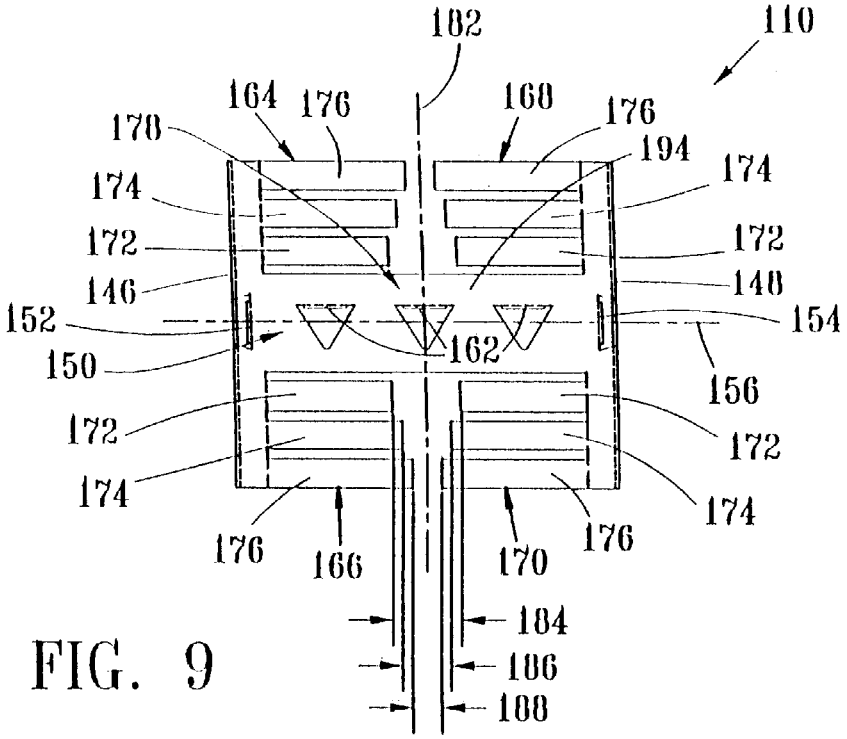
FIG. 9 is a top plan view of the retention clip after bending.
Figure 10:
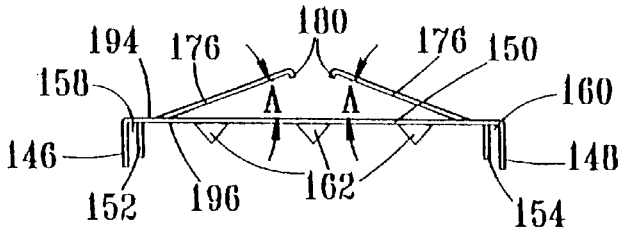
FIG. 10 is a front elevational view of the bent retention clip.

As best seen in FIGS. 8–10, the mounting bracket 110 is preferably stamped from a single flat sheet of metal as shown in FIG. 8, and then bent to the configuration shown most clearly in FIGS. 9 and 10. Preferably, the mounting bracket 110 is manufactured, for example, from 25 gauge spring steel material, which is stamped and bent into the desired shape, and then heat treated to a hardness of about Rockwell 40–44 (Rc 40–44). However, other materials, thicknesses, and hardnesses may be used, depending on the desired final mechanical properties of the bracket. The mounting bracket 110 is bent along dashed lines 142, 144 (FIG. 8) to form a pair of mounting legs 146, 148 respectively, that depend from opposite ends of a middle plate portion 150. A first generally triangular-shaped end barb 152 is formed adjacent the leg 146. Likewise, a second generally triangular-shaped end barb 154 is formed adjacent the leg 148. Preferably, the barbs 152 and 154 are located along a common center line 156. However, the barbs may be positioned at different locations adjacent their respective legs as long as a predetermined fixed distance is maintained between each leg and its associated barb. Although only one barb is shown adjacent each leg 146, 148, more barbs can be formed adjacent the legs if desired. The barbs 152, 154 extend generally parallel to their associated legs to form door skin receiving channels 158, 160, respectively. Three generally triangular-shaped middle barbs 162 extend downwardly from the plate portion 150 and generally parallel to the center line 156. Although three middle barbs are shown, it is to be understood that more or less middle barbs can be formed along the plate portion 150, if desired. The purpose of the barbs 152, 154 and 162 will be described in greater detail below.

Four spring finger sets 164, 166, 168 and 170 are formed in the plate portion 150. Each spring finger set includes a short length spring finger 172, an intermediate length spring finger 174, and a long length spring finger 176. Preferably, the fingers extend generally parallel to the centerline 156 and are of substantially the same width. Each finger 172, 174 and 176 of each set 164, 166, 168 and 170 is bent upward at an acute angle A with respect to a mid-region 178 of the plate portion 150. Each finger 172, 174 and 176 is preferably terminated with a hook 180 that is adapted to contact one of the margins 128 (FIG. 5) of an installed frame member 106, 108. The purpose of the hook, inter alia, is to provide a smooth surface which slides easily over edge 129. Formation of the hooks can be accomplished during bending to thereby eliminate a separate deburring operation to smooth the free end edges of each finger. Preferably, the first spring finger set 164 is symmetrical to the second spring finger set 166 about the centerline 156. Likewise, the first and second spring finger sets 164 and 166 are symmetrical to the third and fourth spring finger sets 168 and 170, respectively, about a lateral centerline 182 that is transverse to the centerline 156. In this manner, a relatively wide channel 184 is formed between opposing ends of the short fingers 172, an intermediate width channel 186 is formed between opposing ends of the intermediate fingers 174, and a relatively narrow channel 188 is formed between opposing ends of the long fingers 176. The channels are adapted to receive opposing margins 128 of the frame members 106, 108 when installed in the cutout 102 of the door. Depending on the amount of tolerance compensation required, each set may contain more or less spring fingers of varying lengths.

For installation of the frame assembly 100 on a solid wood door, mounting brackets 110 are mounted in the cutout 102 such that the mounting legs 146, 148 abut the vertical sides 120, 123 of the door 104 adjacent the cutout edges 119, 121. Since the legs 146, 148 and the spring finger sets of the mounting bracket 110 are symmetrical about the lateral centerline 182, the mounting bracket can be installed with either mounting leg 146, 148 adjacent either vertical side 120, 123 of the door 104. Once one of the mounting brackets is positioned in the cutout, the barbs 152, 154 and 162 are pressed into the wood by applying a force to an upper surface 194 of the plate portion 150 opposite the barbs until a lower surface 196 of the plate portion 150 rests on an inner surface 190 of the cutout. With this arrangement, the barbs serve as gripping means for firmly holding the bracket 110 in the cutout 102. Depending on the size of the cutout 102, it is contemplated that 8 to 14 or more brackets 110 will be installed, preferably two at each inside corner of the cutout and more in the middle portion between the corners, depending on the length of each side of the cutout. Although eight brackets are the preferred minimum, it is to be understood that a fewer number of brackets can be used.

Once the brackets 110 are installed, one of the frame members 106 or 108 is inserted into the cutout 102 and pressed against the fingers 172, 174, 176 of the finger sets 164 and 166 or of the finger sets 168 and 170 until the frame member is in its final mounted position with the outer flange 112 abutting one of the vertical surfaces 120, 123 of the door 104. As the frame member is inserted, the inner free edge 129 of the inner flange 114 (See FIG. 5) will contact and press against the fingers, forcing them to rotate in a direction that causes the angle A between the fingers and the upper surface 194 to decrease, as shown in dashed line in FIG. 11. As the inner free edge 129 clears one or more of the fingers, each cleared finger will spring back to its original bent position and rest against an outer surface 198 of the margin 128. If the edge 129 does not clear all of the fingers, the longer uncleared fingers will be held depressed by edge 129. In general, only the longest of the fingers which is free of edge 129 will bear against margin 128. With one or more of the spring fingers pressing against the margin, and the outer flange 112 pressing against one of the door surfaces, the frame member is locked into place. If the dimensions of the frame and clip are precisely controlled, the inner free edge 129 should be clear of all three fingers 172, 174, 176 such that all the fingers press against the margin 128. Glazing tape or putty 134, the glazing 132, and more glazing tape or putty 134 are then positioned in the cutout and held in place while the second frame member 106 or 108 is installed. Since the frame members 106 and 108 are identical, the remaining frame member can be installed in a similar manner. If the inner free edge 129 should fail to clear one or more of the fingers, the uncleared fingers will remain pressed against a surface 190 of the cutout when the frame members are in their final mounted positions, as shown by fingers 176 in FIG. 5. Preferably, the fingers 172 are sufficiently short to accommodate the greatest amount of anticipated cumulative tolerance so that at least the fingers 172 rest against the margin 128. Due to the flexibility of the fingers, a wide range of tolerances between the width of channel 184 and the width of channel 188 can be accommodated. Thus, the present invention is adaptable to accumulated tolerance variations in the door, window pane, and glazing tape thicknesses, as well as variations in glazing space between the frames. A snug fit for the glazing is thus assured over a wide range of accumulated tolerances.

In general, the space between the margin 128 and the inside of first panel 118 is fixed during the forming of the frame member. The lengths and associated tolerances of the fingers in the cooperating set of spring fingers, together with this manufactured dimension generally determines where the edge 129 will fall relative to the various spring fingers. In addition to these dimensions and tolerances, where edge 129 of the second to be installed frame member will fall relative to the associated set of fingers also depends on at least the associated tolerances, and the nominal thickness of the glazing, the glazing putty, and the door. It is apparent that there is ample opportunity for substantial tolerance build up. Where the only dimensions and tolerances controlled by the maker of the clips and frames are those of these items, it is apparent that the objective of universal application must be aided by a design which is very forgiving of tolerance build up and different nominal dimensions for the door, glazing and putty.

Figure 11:
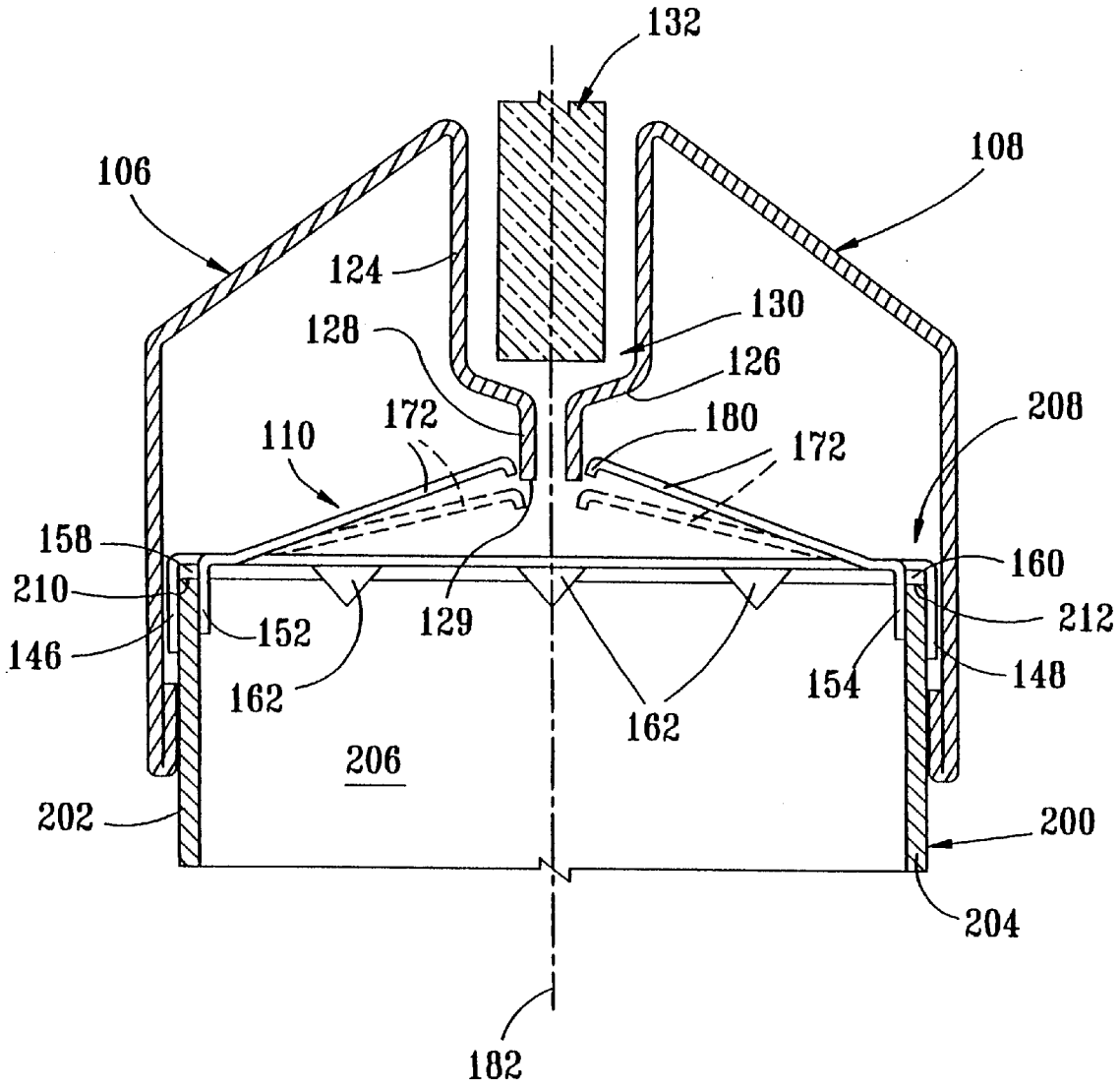
FIG. 11 is an enlarged cross sectional view of a portion of the vision frame assembly during installation in a cutout of a hollow fire-rated door.

The vision frame assembly 100 (See FIG. 5) can also be installed in hollow doors, such as the hollow fire-rated door 200 shown in FIG. 11. The door 200 comprises a front skin 202 separated from a rear skin 204 by a core material 206. The front and rear skins are typically constructed of metal. A cutout 208 in the front and rear skins and core material receives the frame assembly 100. With the exception of the mounting bracket 110, the frame assembly 100 is mounted in the cutout 208 in a manner similar to the installation described above with respect to solid doors. Since the door 200 is hollow, there is no solid material for the barbs to sink into. Instead, the mounting leg 146 and barb 152 form a first door skin receiving channel 158. Likewise, the mounting leg 148 and barb 154 form a second door skin receiving channel 160. Thus, installation of the mounting bracket 110 is accomplished by positioning the bracket in the cutout 208 such that the door skin receiving channels are in alignment with a front cutout edge 210 and a rear cutout edge 212. Since the mounting legs 146 and 148, the barbs 152 and 154, and the spring finger sets of the mounting bracket 110 are symmetrical about the lateral centerline 182, the mounting bracket can be installed with either door skin receiving channel in alignment with either cutout edge 210 or 212. Once the mounting bracket is positioned in the cutout, the bracket is moved toward the cutout edges until the edges are received in the door skin receiving channels. The frame members, glazing, and glazing tape can then be installed as previously described. Thus, the mounting bracket of the present invention is readily mountable without alteration to solid and hollow doors.

For purpose of strength, the outer edge of the panel 118 is generally rolled under as shown, for example, in FIG. 7. This strengthens both the edge itself and the interengagement between the frame member and the clip. The lower edges of mounting legs 146 and 148 engage with the rolled lower edge of the panel 118. If desired, the outer free edges of the panel 118 can be shaped so that they receive and capture the edges of the mounting legs 146 and 148 in a channel formed between the rolled up outer free edge and the inner wall of the panel 118.

What has been described are preferred embodiments in which modifications and changes may be made without departing from the spirit and scope of the accompanying claims. Obviously, many modifications and variations of the present invention are possible in light of the above teachings. It is therefore to be understood that, within the scope and proper coverage of the appended claims, the invention may be practiced otherwise than as specifically described.

What is claimed is:

1. A snap lock vision frame assembly having a generally closed perimeter and comprising:

a resilient latching clip component including a pair of mounting members disposed on opposed edges of a plate portion, said plate portion having a mid-region generally intermediate said opposed edges, at least two generally spaced apart opposed sets of elongated spring finger elements depending respectively from generally adjacent said opposed edges and projecting angularly towards said mid-region, each of said elongated spring finger elements generally being resiliently mounted to the plate portion by one end and terminating in a free end remote from said one end, each said set of elongated spring finger elements including at least two elongated spring finger elements of differing lengths, the free ends of the elongated spring finger elements in the respective opposed sets of elongated spring finger elements being spaced apart in said mid-region to define therebetween a flange receiving channel, said free ends defining respective sides of said flange receiving channel; and first and second frame members, each said frame member having an outer flange and an inner flange, said outer flange extending between an outer free edge and a captive edge, said captive edge being shared with said inner flange, said inner flange extending between said captive edge and an inner free edge and including a step intermediate said captive and inner free edges, said step extending generally away from said outer free edge, said inner and outer free edges being spaced apart by a fixed distance, said fixed distance being approximately equal to the distance between an opposed edge and the closest side of said flange receiving channel, said flange receiving channel being wide enough to receive a margin of each of said inner flanges adjacent said inner free edges, at least one of said free ends from each of said sets of elongated spring fingers being adapted to bear against the margin of an adjacent inner flange.

2. A snap lock vision frame assembly of claim 1 wherein said resilient latching clip component is unitary.

3. A snap lock vision frame assembly of claim 1 wherein each of said first and second frame members is unitary.

4. A snap lock vision frame assembly of claim 1 including barbs depending from said plate portion distal from said flange receiving channel.

5. A snap lock vision frame assembly of claim 1 wherein each of said mounting members comprises a leg spaced apart from a barb to define therebetween a door skin receiving channel, said leg and barb depending from said door skin receiving channel distal from said flange receiving channel.

6. A snap lock vision frame assembly of claim 5 wherein a face of the barb is oriented at least generally parallel with a face of the leg.

7. A snap lock vision frame assembly of claim 2 wherein said resilient latching clip components are generally symmetrical around said flange receiving channel.

8. A snap lock vision frame assembly of claim 7 wherein said opposed sets of spring finger elements are generally symmetrical around said flange receiving channel.

9. A snap lock vision frame assembly of claim 2 wherein said opposed sets of spring finger elements are generally symmetrical around said flange receiving channel.

10. A snap lock vision frame assembly of claim 1 wherein the at least two generally spaced apart opposed sets comprise four sets of elongated spring finger elements.

11. A snap lock vision frame assembly of claim 10 wherein said opposed sets of spring finger elements are generally symmetrical around said flange receiving channel.

12. A snap lock vision frame assembly of claim 11 wherein said opposed sets of spring finger elements are generally symmetrical around an axis that is generally perpendicular to the direction of said flange receiving channel.

13. A snap lock vision frame assembly including a door having a cutout therein with a closed periphery, said assembly comprising:

a plurality of resilient latching clip components arrayed around said cutout, each of said resilient latching clip components including a pair of mounting members disposed on opposed edges of a plate portion and engaged with an edge of said cutout, said plate portion having a mid-region generally intermediate said opposed edges, at least two generally spaced apart opposed sets of elongated spring finger elements depending respectively from generally adjacent said opposed edges and projecting angularly towards said mid-region, each of said elongated spring finger elements generally being resiliently mounted to the plate portion by one end and terminating in a free end remote from said one end, each said set of elongated spring finger elements including at least two elongated spring finger elements of differing lengths, the free ends of the elongated spring finger elements in the respective opposed sets of elongated spring finger elements being spaced apart in said mid-region to define therebetween a flange receiving channel, said free ends defining respective sides of said flange receiving channel; and first and second frame members mounted in said cutout and engaged with said resilient latching clip components, each said frame member having an outer flange and an inner flange, said outer flange extending between an outer free edge and a captive edge, said captive edge being shared with said inner flange, said inner flange extending between said captive edge and an inner free edge and including a step intermediate said captive and inner free edges, said step extending generally away from said outer free edge, the steps in said first and second frame members defining between them the width of a glazing receiving pocket, said inner and outer free edges being spaced apart by a fixed distance, said fixed distance being approximately equal to the distance between an opposed edge and the closest side of said flange receiving channel, a margin of each of said inner flanges adjacent said inner free edges generally being received in the flange receiving channel of each of said resilient latching clip components, at least one of said free ends from each of said sets of elongated spring fingers generally bearing against the margin of an adjacent inner flange.

14. A snap lock vision frame assembly having a generally closed perimeter and comprising:

a first frame member having a first external face and a first glazing face, said first external face extending generally between a first outer edge of the first external face and a first edge of the first glazing face, said first glazing face including a first panel extending between the first edge and a first step, said first step extending away from said first outer edge, and a first flange depending from said first step, said first flange terminating in a first spring finger engaging edge;

a second frame member having a second external face and a second glazing face, said second external face extending generally between a second outer edge of the second external face and a second edge of the second glazing face, said second glazing face including a second panel extending between the second edge and a second step, said second step extending away from said second outer edge, and a second flange depending from said second step, said second flange terminating in a second spring finger engaging edge, said first and second frame members being adapted to being mounted with said first and second flanges in opposing relationship and with said first and second panels spaced apart and defining therebetween a glaze receiving nest; and a resilient latching clip component including a pair of mounting members disposed on opposed edges of a plate portion, said plate portion having a mid-region intermediate said opposed edges, a first set of elongated spring finger elements resiliently cantilevered from said plate portion generally adjacent a first of said opposed edges and extending towards said mid-region at an acute angle, a second set of elongated spring finger elements resiliently cantilevered from said plate portion adjacent a second of said opposed edges and extending towards said mid-region at an acute angle, each of said sets of elongated spring finger elements including at least two elongated spring finger elements of differing lengths, each of said elongated spring finger elements having a free end adjacent said mid-region and spaced from said plate portion by a predetermined distance, the free ends of the elongated spring finger elements in the respective first and second sets of elongated spring finger elements defining therebetween a channel, said first and second spring finger engaging edges being adapted for reception in said channel with at least one of said elongated spring finger elements in each of said sets of elongated spring finger elements bearing on an adjacent face of one of said first and second flanges.

* * * * *